US008112902B2

(12) United States Patent
Muenzner et al.

(10) Patent No.: US 8,112,902 B2
(45) Date of Patent: Feb. 14, 2012

(54) METHOD FOR DETERMINING THE LOAD QUANTITY IN A SPIN DRYER AND SPIN DRYER

(75) Inventors: Rainer Muenzner, Schwarzenberg (DE); Kay Schmidt, Graben-Neudorf (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 1130 days.

(21) Appl. No.: 11/935,019

(22) Filed: Nov. 5, 2007

(65) Prior Publication Data

US 2008/0104860 A1 May 8, 2008

(30) Foreign Application Priority Data

Nov. 6, 2006 (DE) ..... 10 2006 053 274

(51) Int. Cl.
*F26B 11/03* (2006.01)

(52) U.S. Cl. ..... 34/381; 34/413; 34/497; 68/15; 68/12.09; 165/10

(58) Field of Classification Search ..... 34/73, 76, 34/77, 601, 610, 381, 413, 497; 68/15, 12.09; 165/10

See application file for complete search history.

(56) References Cited

U.S. PATENT DOCUMENTS 3,016,623 A * 1/1962 Hamilton et al. ..... 34/557
3,110,005 A * 11/1963 Kripke ..... 338/35
3,116,982 A * 1/1964 McIlvaine ..... 34/529
3,122,426 A * 2/1964 Horecky ..... 34/531
3,216,126 A * 11/1965 Brucken et al. ..... 34/527
3,221,417 A * 12/1965 Mellinger ..... 34/528
3,253,347 A * 5/1966 Kripke ..... 34/546
3,417,480 A * 12/1968 Thunander ..... 34/528
3,613,253 A * 10/1971 Smith ..... 34/532
3,651,579 A * 3/1972 Smith ..... 34/532
3,660,909 A * 5/1972 Willcox ..... 34/533
3,707,773 A * 1/1973 Wolfberg et al. ..... 34/259
3,733,712 A * 5/1973 Smith ..... 34/532
3,762,064 A * 10/1973 Offutt ..... 34/550
3,769,716 A * 11/1973 Janke et al. ..... 34/500
3,840,340 A * 10/1974 McKnight ..... 8/142

(Continued)

FOREIGN PATENT DOCUMENTS

EP 1 295 979 3/2003

(Continued)

OTHER PUBLICATIONS

European Search Report for European Application No. 07020564.6 dated Sep. 4, 2009.

(Continued)

*Primary Examiner* — Stephen M. Gravini
(74) *Attorney, Agent, or Firm* — Alston & Bird LLP

(57) ABSTRACT

A spin or tumble dryer having an air outlet with a moisture sensor is connected to a controller. The moisture sensor determines and stored the measured absolute atmospheric humidity values in the air outlet during operation. Specific characteristic values of the detected moisture can be determined, such as at a point in time and the duration to reach a maximum value or an absolute atmospheric humidity at a specific instant, which can be compared with the values stored in the controller. From this, it is possible to determine the laundry load quantity that is located in the spin dryer, and as a result a program sequence for drying the load can be optimized.

4 Claims, 2 Drawing Sheets

U.S. PATENT DOCUMENTS

| | | | | | |
|---|---|---|---|---|---|
| 4,015,366 | A | * | 4/1977 | Hall, III | 47/1.43 |
| 4,170,251 | A | * | 10/1979 | Hine, II | 141/11 |
| 4,221,058 | A | * | 9/1980 | Zagorzycki | 34/557 |
| RE31,023 | E | * | 9/1982 | Hall, III | 405/37 |
| 4,413,427 | A | * | 11/1983 | Villalobos et al. | 34/540 |
| 4,525,937 | A | * | 7/1985 | Strandberg et al. | 34/550 |
| 4,546,442 | A | * | 10/1985 | Tinker | 96/114 |
| 4,718,020 | A | * | 1/1988 | Duich et al. | 700/271 |
| 4,733,479 | A | | 3/1988 | Kaji et al. | |
| 4,795,871 | A | | 1/1989 | Strattan et al. | |
| 4,862,599 | A | * | 9/1989 | Brunner | 34/536 |
| 5,042,171 | A | | 8/1991 | Obata et al. | |
| 5,050,313 | A | | 9/1991 | Wakaeya et al. | |
| 5,187,879 | A | * | 2/1993 | Holst | 34/261 |
| 5,315,765 | A | * | 5/1994 | Holst et al. | 34/260 |
| 5,321,897 | A | * | 6/1994 | Holst et al. | 34/260 |
| 5,347,727 | A | | 9/1994 | Kim | |
| 5,444,637 | A | * | 8/1995 | Smesny et al. | 702/127 |
| 5,651,192 | A | * | 7/1997 | Horwitz | 34/529 |
| 5,755,041 | A | * | 5/1998 | Horwitz | 34/491 |
| 6,112,131 | A | * | 8/2000 | Ghorashi et al. | 700/142 |
| 6,122,840 | A | | 9/2000 | Chbat et al. | |
| 6,199,300 | B1 | * | 3/2001 | Heater et al. | 34/446 |
| 6,249,988 | B1 | * | 6/2001 | Duske et al. | 34/62 |
| 6,446,357 | B2 | * | 9/2002 | Woerdehoff et al. | 34/491 |
| 6,505,369 | B1 | | 1/2003 | Weinmann | |
| 6,845,290 | B1 | * | 1/2005 | Wunderlin et al. | 700/208 |
| 6,868,621 | B1 | * | 3/2005 | Grimm et al. | 34/92 |
| 7,013,578 | B2 | * | 3/2006 | Wunderlin et al. | 34/528 |
| 7,027,887 | B2 | * | 4/2006 | Gaylo et al. | 700/117 |
| 7,055,262 | B2 | * | 6/2006 | Goldberg et al. | 34/86 |
| 7,280,892 | B2 | * | 10/2007 | Bavel | 700/284 |
| 7,478,486 | B2 | * | 1/2009 | Wunderlin et al. | 34/491 |
| 7,665,225 | B2 | * | 2/2010 | Goldberg et al. | 34/73 |
| 2002/0000049 | A1 | * | 1/2002 | Woerdehoff et al. | 34/313 |
| 2004/0200093 | A1 | * | 10/2004 | Wunderlin et al. | 34/606 |
| 2005/0066538 | A1 | * | 3/2005 | Goldberg et al. | 34/218 |
| 2005/0251289 | A1 | * | 11/2005 | Bonney et al. | 700/244 |
| 2006/0179676 | A1 | * | 8/2006 | Goldberg et al. | 34/77 |
| 2006/0191161 | A1 | * | 8/2006 | Wunderlin et al. | 34/562 |
| 2006/0218812 | A1 | * | 10/2006 | Brown | 34/86 |
| 2007/0016328 | A1 | * | 1/2007 | Ziegler et al. | 700/245 |
| 2007/0144027 | A1 | * | 6/2007 | Renaud | 34/60 |
| 2008/0104860 | A1 | * | 5/2008 | Muenzner et al. | 34/427 |
| 2008/0140255 | A1 | * | 6/2008 | Ziegler et al. | 700/245 |
| 2008/0155768 | A1 | * | 7/2008 | Ziegler et al. | 15/4 |
| 2009/0255142 | A1 | * | 10/2009 | Brown | 34/79 |
| 2010/0000112 | A1 | * | 1/2010 | Carow et al. | 34/357 |
| 2010/0152880 | A1 | * | 6/2010 | Boyden et al. | 700/117 |
| 2010/0168900 | A1 | * | 7/2010 | Boyden et al. | 700/117 |
| 2010/0257833 | A1 | * | 10/2010 | Freeman et al. | 56/341 |
| 2011/0015784 | A1 | * | 1/2011 | Freeman et al. | 700/240 |
| 2011/0041260 | A1 | * | 2/2011 | Balinski et al. | 8/159 |
| 2011/0041562 | A1 | * | 2/2011 | Balinski et al. | 68/20 |
| 2011/0083338 | A1 | * | 4/2011 | Carow et al. | 34/329 |
| 2011/0099834 | A1 | * | 5/2011 | Brown | 34/132 |

FOREIGN PATENT DOCUMENTS

| | | | | |
|---|---|---|---|---|
| EP | 1790769 | A1 | * | 5/2007 |
| JP | 55072749 | A | * | 5/1980 |
| JP | 56000648 | A | * | 1/1981 |
| JP | 56014147 | A | * | 2/1981 |
| JP | 56096235 | A | * | 8/1981 |
| JP | 56111448 | A | * | 9/1981 |
| JP | 57153721 | A | * | 9/1982 |
| JP | 58082479 | A | * | 5/1983 |
| JP | 58153031 | A | * | 9/1983 |
| JP | 59095327 | A | * | 6/1984 |
| JP | 62060934 | A | * | 3/1987 |
| JP | 62291531 | A | * | 12/1987 |
| JP | 01076681 | A | * | 3/1989 |
| JP | 01077445 | A | * | 3/1989 |
| JP | 02134579 | A | * | 5/1990 |
| JP | 02147099 | A | * | 6/1990 |
| JP | 02229554 | A | * | 9/1990 |
| JP | 02257998 | A | * | 10/1990 |
| JP | 03148545 | A | * | 6/1991 |

OTHER PUBLICATIONS

Cheremisinoff, Nicholas P., "Handbook of chemical processing equipment," Excerpt, p. 127: Butterworth-Heinemann, 2000.

* cited by examiner

METHOD FOR DETERMINING THE LOAD QUANTITY IN A SPIN DRYER AND SPIN DRYER

CROSS REFERENCE TO RELATED APPLICATIONS

This application is based on German Patent Application No. 102006053274.0 filed on Nov. 6, 2006, of which the contents are hereby incorporated by reference.

FIELD OF APPLICATION AND PRIOR ART

The invention relates to a method for determining a quantity of a laundry load in a spin or tumble dryer, as well as a correspondingly constructed spin or tumble dryer operating according to this method.

BACKGROUND FOR THE INVENTION

There are numerous ways in which the load quantity of a spin dryer can be determined. From U.S. Pat. No. 6,505,369 B1 it is known how to determine an unbalanced condition during spinning and from this information determine the load quantity.

It is also known from EP 1 295 979 B1 how to measure the electrical resistance or conductance of the laundry contents in the spin dryer. From this, the laundry load quantity can be determined in conjunction with the elapsed time. However, as in the spin dryer the laundry quantity is constantly being shaken about, the measurements in this method are imprecise.

It is also known from U.S. Pat. No. 5,347,727 B1 to use both humidity or moisture sensors and also temperature sensors for measuring the laundry load. From the measured results thereof it is also possible to determine the load quantity, but the component costs are high.

BRIEF DESCRIPTION OF THE DRAWINGS

An embodiment of the invention is described in greater detail hereinafter relative to the attached drawings, wherein.

DETAILED DESCRIPTION OF THE EMBODIMENTS

Figure 1:
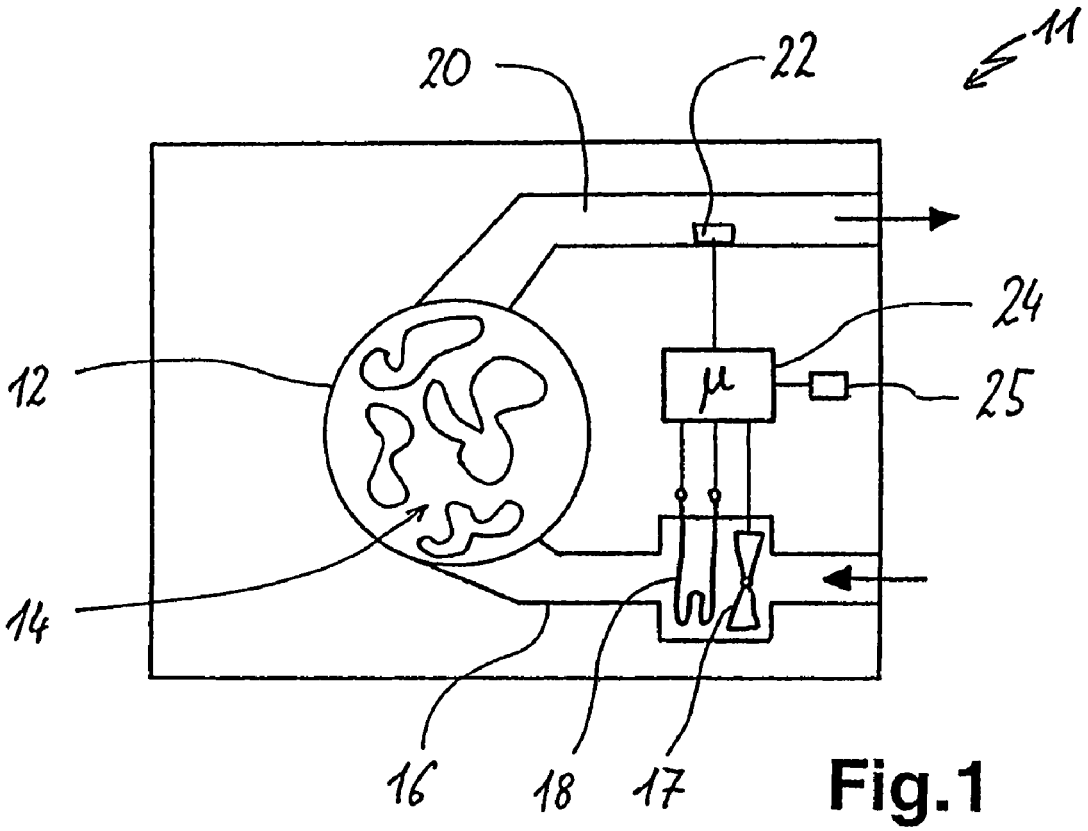
FIG. 1 illustrates an inside view of an inventive spin or tumble dryer.

A problem addressed by the invention is to provide an aforementioned method and a corresponding spin dryer making it possible to avoid the disadvantages of the prior art and in particular making it possible to determine the laundry load quantity in a spin dryer at limited cost.

This problem is solved in one embodiment by a method having the features of a corresponding spin or tumble dryer according to an example embodiment of the invention. Advantageous and preferred embodiments of the invention form the subject matter of the remaining claims and are explained in greater detail hereinafter. Some of the features are only described once. However, independently of this, they apply both to the method and to the correspondingly constructed spin dryer. By express reference, the wording of the claims is made into part of the content of the description.

The absolute atmospheric humidity is measured in the air outlet which leads away from the spin dryer loading chamber or drum. The invention can be used with particular advantages in the case of exhaust air spin dryers, which blow the moist air into the external environment, but it is not restricted thereto. According to one embodiment of the invention, the laundry load quantity in the loading chamber is determined in that the maximum value and/or the course over time, the absolute atmospheric humidity is determined in the air outlet or in the air removed from the spin dryer loading chamber. For this purpose, the measured values are continuously determined and as soon as they fall again following an initial rise, the maximum value is determined to have been just exceeded. For this purpose, it is normally only necessary to have one moisture sensor, which reduces component costs and also the installation duration.

Use is made of the fact that a correlation exists between the absolute atmospheric humidity and the water quantity present in the laundry or washing. In turn said water quantity, particularly with known residual moisture following the washing process, is dependent on the laundry load quantity and as a result conclusions can be drawn regarding the laundry load quantity from the absolute atmospheric humidity. In certain circumstances, the absolute atmospheric humidity can be influenced by the nature of the laundry load or the material. For this purpose, it is possible to obtain information from the nature of the chosen drying program and it can in particular be detected whether, for example, the load comprises cotton laundry to be dried. As will be explained in greater detail hereinafter, an attempt can also be made to more precisely establish this residual moisture.

In the method involving the determination of the maximum value of the absolute atmospheric humidity, the individual values are compared with one another and use is made of the highest or maximum value thereof. This determination of values can take place in a specific time window. It can alternatively be assumed that the maximum value has been determined, if for a given time after the hitherto highest value, for example a few minutes, no higher value has been determined.

Determination takes place somewhat differently if the course of the absolute atmospheric humidity is monitored over the course of time. Then, the measured values are compared relative to one another and not with respect to the absolute value thereof. If the preponderant number of successive measured values for the absolute atmospheric humidity in each case exceeds the preceding value, then the curve rises. If the preponderant number of measured values is below the preceding value, then the curve falls. If, in each case for this purpose, a time window of a few moments is chosen, it is also possible to draw conclusions concerning the maximum through observing the gradient over the course of the absolute atmospheric humidity.

The course of the absolute atmospheric humidity is normally such that after loading the moist laundry load and the start of operation, the curve rises sharply, after which it falls or flattens out and then reaches a rather shallow maximum and from there drops away in a relatively shallow manner. The moister the laundry load that is present in the loading chamber, the higher the maximum value of the absolute atmospheric humidity and the more shallow is its drop off over time. The differences in the maximum values as a function of the load quantity are so great that they permit a determination of the load quantity on the basis of the maximum value of different curves dependent on said load quantity.

The advantage of determining the washing load quantity present in the loading chamber is that automatic program sequences can be optimized or better adapted to the load quantity actually present. The essential reason for this is that the degree of moisture of the laundry following a washing process is normally within a relatively narrow range, i.e., is roughly always the same, particularly a residual moisture of approximately 50 to 70%, i.e., measuring the weight of water contained relative to the weight of the washing. If the load quantity is known, then the entire moisture in the loading chamber can be determined and a program sequence matched thereto, particularly with respect to duration, intensity of heating, etc.

It is advantageously possible that values are stored for a correlation of maximum values of the absolute atmospheric humidity with a specific load quantity. This means that with a given assumed residual moisture of the laundry load, a link is stored between the maximum value of the absolute atmospheric humidity and the given load quantity, particularly for a specific spin dryer type. By performing a comparison in a spin dryer controller, using the maximum value of the absolute atmospheric humidity determined by measurement, it is possible to establish the quantity of the laundry load present in the loading chamber.

In an alternative embodiment of the invention, the laundry load quantity in the loading chamber is determined by establishing a value of the absolute atmospheric humidity in the loading chamber air outlet at a specifically defined time following the start of spin dryer operation. Advantageously, values for the absolute atmospheric humidity at a specific instant are stored in correlation with a specific washing load quantity in the spin dryer. In the spin dryer controller, it is again possible to carry out a comparison of the measured, absolute atmospheric humidity at a specific instant and values stored therewith. From this it is once again possible to establish the load quantity in the loading chamber. As for the aforementioned possibility of comparing maximum values of the absolute atmospheric humidity with a load quantity in the loading chamber, for this purpose, the values can be experimentally determined for a specific spin dryer type and then stored in a controller.

The aforementioned, specific instant can advantageously be between 5 and 40 minutes following the start of operation. Advantageously, account is taken of the fact that in the first 5 minutes the absolute atmospheric humidity value still rises so steeply that said behaviour is essentially independent of the load quantity. Only after a longer time period is there a change to the paths or curves as a function of the load quantity. Advantageously, the specific instant is at approximately 15 to 20 minutes. In many cases, this instant occurs after reaching the maximum value when the path is already falling again.

According to a further embodiment of the invention for determining the load quantity, use is made of the point in time at which the absolute atmospheric humidity gradient, i.e., the gradient of its path curve, assumes a specific value. Here again, advantageously values are stored for a correlation of different values of the gradient at specific instants with a specific load quantity dependent thereon. A spin dryer controller again makes the comparison between the measured, recorded gradient of the absolute atmospheric humidity and the time instant. As previously stated, this once again makes it possible to determine the moist washing load quantity in the loading chamber.

One particular advantage for the aforementioned development of the method is that use is made of the instant at which the absolute atmospheric humidity gradient is already negative again, i.e., after reaching the maximum value. The advantage of this method is that there is a wait over a longer time, for example 20 to 30 minutes. In this time range the aforementioned courses for measuring the absolute atmospheric humidity as a function of time differ from one another according to the load quantity, allowing a distinction of the load quantity possible. It is also possible to make use of the instant at which the absolute atmospheric humidity gradient has become zero. It can be an instant of time at which the gradient, starting therefrom, becomes lower, or drops away, and is negative.

Advantageously, the time duration of a plateau-like path of the absolute atmospheric humidity is established and from this the determination takes place of the residual humidity of the load following the washing process and before the drying process. The longer the plateau phase time period, the higher the residual humidity can be assumed. If this residual humidity is known, it is even more precisely possible to determine with it the probable end of the drying process. The plateau phase can be defined in such a way that during it a variation of the absolute atmospheric humidity of max 10% below the maximum value is allowed. However, the path of the absolute atmospheric humidity is relatively shallow.

In the aforementioned spin or tumble dryer constructed for implementing the above-described method, a moisture sensor of a generally known type is located in the air outlet from the loading chamber from which can be gathered from the aforementioned prior art and is connected to the spin dryer controller. The latter is constructed not only for determining the measured values of the moisture sensor, but can also record the measured values or their trend. The aforementioned values are stored for the indicated correlations in a memory of said controller. The controller advantageously also has a time determination for the time which has elapsed since the start of operation.

These and further features can be gathered from the claims, description and drawings and the individual features, both singly and in the form of subcombinations, can be implemented in an embodiment of the invention and in other fields and can represent advantageous, independently protectable constructions for which protection is claimed here. The subdivision of the application into individual sections and the subheadings in no way restricts the general validity of the statements made thereunder.

FIG. 1 shows a spin dryer (a.k.a tumble dryer) 11 according to the invention. The representation is limited to the functionally necessary parts and is merely tended to illustrate how said spin dryer parts function. The laundry load or washing 14 is located in loading chamber 12 and has a residual moisture content following washing or spinning. The chamber 12 is normally rotated, but this is not decisive for the purposes of the invention. Air is introduced into loading chamber 12 by means of an air inlet 16. The air flow is brought about by fan 17 and heated by the downstream electric air heater 18 for drying the laundry load 14. Similarly, an air outlet 20 leads to the outside from the loading chamber or drum 12, so that said spin dryer 11 is referred to as an exhaust air spin dryer. As is known in connection with such spin dryers, the hot air is supplied to the washing 14, absorbs moisture and transports it via air outlet 20 to the outside, so as in this way to dry the washing.

For the determination of the atmospheric humidity of the exhaust air a moisture or humidity sensor 22 is placed in air outlet 20. Such a moisture sensor 22 is known to the expert and need not be explained here. Moisture sensor 22 is connected to a controller 24, as is fan 17 and heater 18. Controller 24 has a memory 25, possibly incorporated in an integrated manner, in which the different values can be stored and further reference will be made thereto hereinafter.

In addition to its use for an exhaust air spin dryer 11 as shown in FIG. 1, the invention can also be used in modified form for a condensation spin dryer. For this purpose, a corresponding moisture sensor is placed in an air outlet from the loading chamber upstream of a following condensation device. Thus, it is also possible to determine therein the absolute atmospheric humidity in the exhaust air.

Figure 2:
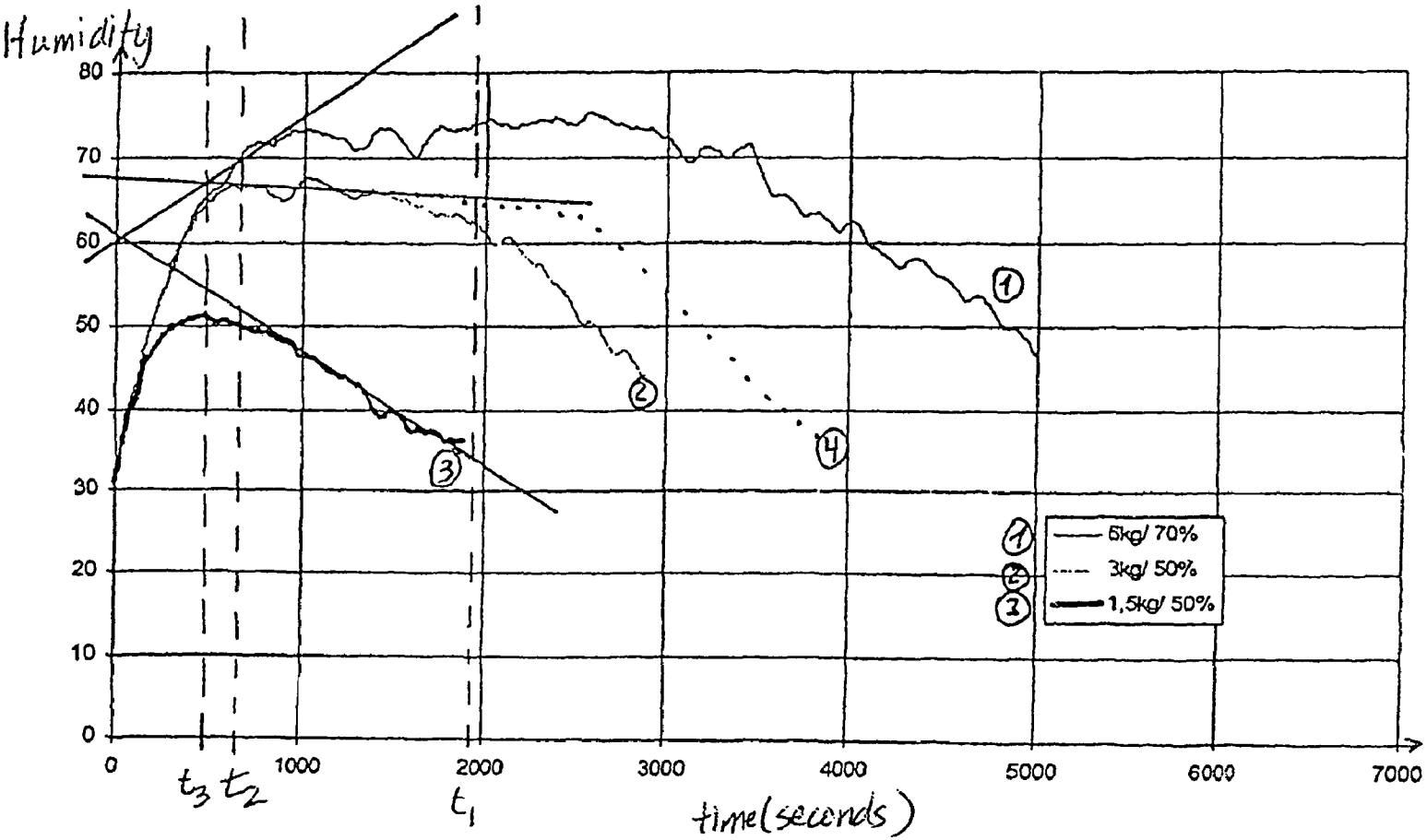
FIG. 2 illustrates a graph for different paths or curves of the absolute atmospheric humidity over time for different washing or laundry quantity loads for the spin dryer according to FIG. 1.

FIG. 2 shows several courses or curves of the atmospheric humidity over time. The first curve 1 applies to a case in which there are 5 kg of washing in the loading chamber 12 of spin dryer 11 according to FIG. 1. The second curve 2 shows a drying process for 3 kg of washing and the third curve 3 for 1.5 kg thereof. In the first curve 1 it is assumed that there is an actual laundry residual moisture of around 70% prior to the start of the drying process at time t=0 (prior to operation) and in the two other curves the laundry has an actual residual moisture of about 50%. The difference in the curves is also due to the fact that the absolute atmospheric humidity in air outlet 20 is dependent on the surface of washing 14. In turn, the surface is dependent on the quantity of the laundry load or the weight thereof The aim is to establish the quantity of the laundry load. Thus, conclusions can be drawn regarding the load quantity from the absolute atmospheric humidity level.

It is possible to see how initially all three curves are very similar. Only after about 2 minutes does the third curve 3 for the smallest washing quantity start to deviate from the other curves and then after about 500 seconds, or somewhat over 8 minutes operation, is a maximum humidity reached. From this maximum, the curve falls again with a roughly constant gradient.

This means that at the start of the drying process and independent of the laundry load quantity, the atmospheric humidity in the air outlet 20 determined by moisture sensor 22 is the same. This is due to the fact that during the starting up of the spin dryer 11, the maximum removable moisture from the washing 14 is roughly the same in each case.

The second curve 2 for a 3 kg load is the same as the first curve over a relatively long time period but then significantly flattens out after about 10 minutes (about 600 seconds), following which it assumes a not completely distinct maximum value and then after about 16 minutes (about 960 seconds), it again falls increasingly steeply.

The first curve 1 for a 5 kg load flattens out somewhat later than the second curve, namely after about 12 to 14 minutes (720-840 seconds) and reaches a maximum value at somewhat over 30 minutes (1800 seconds). At somewhat over 40 minutes (2400 seconds), the curve slowly and then more steeply falls again.

It is clear from the three curves that the atmospheric humidity as a function of time in FIG. 2 can be used by for differentiation purposes and therefore for determining the load quantity. In certain circumstances, they can be used alternatively or additionally for determining further values such as the residual moisture or the like.

FIG. 2 shows in broken line form a line 4 where a maximum atmospheric humidity value is reached. Stored corresponding values can be polled by controller 24 from memory 25. Thus, on the basis of the maximum values of the curves according to FIG. 2, the controller 24 can determine how much laundry is present in the loading chamber 12. However, particularly in the case of curve 1, the maximum value determination is subject to significant imprecision. A determination to precisely 1 minute is not necessary in the spin dryer control method and the imprecision need be only a few minutes.

For the second curve 2 with 3 kg of washing is shown in dotted line form how the path would be if the residual moisture was 70% as for the 5 kg curve. However, this dotted line curve is only schematic. It is intended to illustrate how in place of the roughly detectable curve maximum there is a wider, plateau-like path, as compared to the curve for 5 kg. The situation would be similar for the curve with 1.5 kg.

Although providing information on the residual moisture of the washing following the washing process, it is to be assumed that the width or time duration of the plateau must be considered in comparison with the washing quantity. Thus, such a plateau phase for the 1.5 kg washing curve is shorter than for 5 kg of washing. If for example, in the case of curve 2 the residual moisture would be even higher than that of the dotted representation corresponding to 70%, the plateau phase would be even more extensive or longer.

To this extent according to a second previously described possibility, use can be made of the absolute atmospheric humidity value following a given time. In FIG. 2, for example, a time of somewhat over 16 minutes (960 sec.) is suitable. At this time curve 1 has not yet reached its maximum value, curve 2 is approaching its maximum value and curve 3 is already falling again. As can be seen, at this instant or a similar instant, the curves differ sufficiently in order to distinguish from one another by comparison.

According to another possibility, a gradient of the curve can be determined, particularly at a later instant or after exceeding the given maximum value. For this case, either a fixed instant can be provided, for example at roughly 16 minutes (960 seconds), in order to determine a curve similar to that of curve 3. This is drawn in through lines corresponding to the value for the gradient. It is also possible, for example, to continuously determine the gradient for determining the reaching of the maximum value. As soon as the gradient has become consistently negative, either the exceeding of the maximum is detected, or a then determination of the gradient is linked with the time of said determination and this is in turn compared with corresponding stored values.

According to another embodiment of the invention, by observing the present values for the absolute atmospheric humidity, it is possible to await the exceeding of the maximum. A specific point in time thereafter, for example somewhat less than 10 minutes (600 seconds) thereafter, is used in order to then measure the gradient of the path or curve. This also provides certainty that there is a readily determinable and comparable value for the gradient.

According to yet another embodiment of the invention, it is once again possible to continuously determine the gradient. It is then possible to establish the time at which the gradient assumes a specific value. Also, as a result of this characteristic as to the particular instant at which one of the curves of FIG. 2 has a certain gradient, the curves can be distinguished from one another and therefore the quantity of washing 14 in the loading chamber 12 of spin dryer 11 can be determined. By combining the aforementioned determination possibilities, it is inter alia also possible to draw conclusions regarding other values, such as the load residual moisture at the start of the drying process.

As soon as the laundry load quantity 14 is known and optionally the further aforementioned values, the controller 24 can base thereon the sequence of the drying process with respect to time, air supply and possibly air temperature. Thus, an optimized drying process regarding result and energy costs can be implemented. It is possible for certain of the determined values, particularly the washing quantity, and in certain circumstances the residual moisture of the washing in loading chamber 12, to be displayed on a display on the spin dryer 11 as user information.

The invention claimed is:

1. A method for determining a laundry load quantity in a dryer comprising a loading chamber with an air outlet having a moisture sensor for measuring an absolute atmospheric humidity in said air outlet comprising the steps of:

establishing a maximum value over time of said absolute atmospheric humidity in said air outlet based on measurement by said moisture sensor during operation of said laundry dryer; and determining said load quantity in said loading chamber using only said maximum value.

2. The method according to claim 1, wherein reference values for correlating said maximum value of said absolute atmospheric humidity with a specific load quantity are stored in a memory for a comparison and further comprising the step of:

determining said laundry load in said loading chamber by comparing said maximum value of said absolute atmospheric humidity with said reference values.

3. Method according to claim 1, wherein a time duration of a plateau-like course of said absolute atmospheric humidity is established and from said course a residual humidity of said laundry load following a washing process is determined, wherein the longer said time duration of said plateau phase is, the higher said residual humidity is assumed to be.

4. Method according to claim 3, wherein said plateau phase is defined in such a way that during it a variation of said absolute atmospheric humidity of max 10% below said maximum value is allowed.

* * * * *